US005143362A

United States Patent [19]

Doane et al.

[11] Patent Number: 5,143,362

[45] Date of Patent: Sep. 1, 1992

[54] PUBLICATION PERSONALIZATION

[75] Inventors: I. Gerald Doane; Franklin L. Burket, both of Grand Island, N.Y.

[73] Assignee: Moore Business Forms, Inc., Grand Island, N.Y.

[21] Appl. No.: 729,724

[22] Filed: Jul. 15, 1991

[51] Int. Cl.[5] ..... B41F 13/54

[52] U.S. Cl. ..... 270/1.1; 270/45; 270/53; 270/54; 270/58

[58] Field of Search ..... 270/1.1, 53, 54–58, 270/52, 45

[56] References Cited

U.S. PATENT DOCUMENTS

| | | | |
|---|---|---|---|
| 3,608,888 | 9/1971 | McCain | 270/54 |
| 3,774,901 | 11/1973 | McCain et al. | 270/54 |
| 3,819,173 | 6/1974 | Anderson et al. | 270/54 |
| 3,891,492 | 6/1975 | Watson | 156/351 |
| 3,899,165 | 8/1975 | Abram et al. | 270/54 |
| 4,022,455 | 5/1977 | Newsome et al. | 270/54 |
| 4,121,818 | 10/1978 | Riley et al. | 270/54 |
| 4,279,409 | 7/1981 | Pemberton | 270/5 |
| 4,395,031 | 7/1983 | Gruber | 270/54 |
| 4,483,526 | 11/1984 | Bulka et al. | 270/54 |
| 4,500,083 | 2/1985 | Wong | 270/54 |
| 4,576,370 | 3/1986 | Jackson | 270/54 |
| 4,585,220 | 4/1986 | Zemke et al. | 270/54 |
| 4,678,174 | 7/1987 | Reist | 270/54 |
| 4,768,766 | 9/1988 | Berger et al. | 270/58 |
| 4,789,147 | 12/1988 | Berger et al. | 270/1.1 |
| 4,923,189 | 5/1990 | Nail | 270/54 |
| 4,989,850 | 2/1991 | Weller | 270/1.1 |
| 5,005,815 | 4/1991 | Auksi | 270/1.1 |
| 5,013,019 | 5/1991 | Samuels | 270/1.1 |
| 5,039,075 | 8/1991 | Mayer | 270/1.1 |

FOREIGN PATENT DOCUMENTS

| | | | |
|---|---|---|---|
| 967668 | 5/1975 | Canada | 270/54 |
| 3421208 | 12/1985 | Fed. Rep. of Germany | 270/1.1 |
| WO88/02734 | 4/1988 | PCT Int'l Appl. . | |

OTHER PUBLICATIONS

Graphic Arts Monthly, Nov., 1989 "Demographic Binding" by Peter Johnston, pp. 46, 48 and 50.

*Primary Examiner*—Edward K. Look
*Assistant Examiner*—Therese M. Newholm
*Attorney, Agent, or Firm*—Nixon & Vanderhye

[57] ABSTRACT

A method and apparatus provide for the personalization of magazines and like "book" publications. A book, having a cover which provides address information, is formed from a number of signatures. This is accomplished by automatically printing at least one personalized signature with variable personalized printing (such as by ion deposition), assembling the personalized signature with at least one other signature, detecting the personalized printing on the personalized signature (as by optically scanning OCR characters), and in response to such detecting, printing address information on the cover. The personalized printing can be the addressee's name, photograph, or identification number. The personalized signature may be assembled with other business documents, such as a business reply envelope, and may be perfed to provide a return form. Alternatively, complete address information may be printed on the signature and a die cut window formed in the cover, through which the address information is visible once the book is assembled. All of the books having address information with common postal codes are produced in a sequence—regardless of the demographic form of the signature that has been personalized—so as to maximize the chances for securing a minimum postal rate.

25 Claims, 5 Drawing Sheets

PUBLICATION PERSONALIZATION

BACKGROUND AND SUMMARY OF THE INVENTION

Demographic publishing has become very popular since it allows advertising targeting of a group of subscribers to a particular magazine or like publication who have an enhanced probability of being interested in the advertising provided. In demographic publishing a number of different forms of signatures having specific demographic appeal are printed, each type of form having different demographic appeal than the others. Each subscriber is then sent a form of magazine—produced utilizing the signature having the specific demographic appeal form—having demographic information that likely will appeal to that subscriber. All magazines having a signature of each particular form are produced in postal code sequence in order to obtain bulk mailing rates.

A more recent technique utilized in the printing of magazines and other publications is the personalization and addressing of the magazine as part of the bindery process. Commercially, this is most commonly done with low resolution ink jet technology, because of its speed and non-contact imaging. However such technology is limited in quality and coverage, hence limiting the ability to add a high degree of personalization to magazines or like "book" bound, publications. One alternative that has been used in areas having very low labor costs is to simultaneously image a label placed on a signature with addressing information at the same time the signature is printed with variable data, and then later—in a manual operation—removing the pressure sensitive adhesive label from the signature and positioning this label manually on the cover of the publication. This technique is only practical where the labor costs are extremely low, however, and also may leave a readily discernible "void" area on the signature at the point at which the pressure sensitive adhesive label has been removed, or require detachment of an entire section of where the label was printed.

According to the present invention, a method and apparatus are provided for imaging and folding publication signatures at high speed with high quality, integrating the imaged signatures as part of the normal bindery process, detecting data on the imaged signatures, and using the detected information to access a data base of addressing information and ultimately electronically printing the addressing information on the cover of the publication. The method according to the invention is completely automatic, provides the ability to add a high degree of personalization to traditionally bound publications, and does so in a high quality manner. The method and apparatus according to the invention are particularly useful with ion deposition printing of the personalized information, although other printing techniques can also be utilized. The printing of the address information can be by ink jet printing since the address information, itself, need not be high quality.

In the present specification and claims, the generic term "book" is utilized. This term is intended to encompass magazines, newsletters, and other like types of bound publications. The term "signature" has its normal meaning in the book publishing field.

According to one aspect of the present invention, a method of forming a book, having a cover adapted to receive address information, from a plurality of signatures is provided, the method comprises the steps of automatically: (a) Printing at least one personalized signature with variable, detectable, personalized printing. (b) Assembling the personalized signature with at least one other signature. (c) Detecting the detectable personalized printing on the personalized signature. And, (d) in response to (c), printing address information on the cover. The variable, detectable, personalized printing must of course be of high quality. The two most practical types of personalized printing are OCR characters and bar code, in which case step (c) is practiced by optically scanning. However magnetic printing and detecting can also be utilized.

Step (a) may be practiced by printing complete mailing address information on the personalized signature, while step (c) is practiced by optically scanning the complete mailing address information and step (d) is practiced by temporarily storing the complete address information and then printing essentially that same information on the cover. Alternatively step (d) may be practiced by comparing the personalized printing detected in step (c) with information in a data base, and withdrawing favorably compared information from the data base.

The method may also comprise the further step (e) of assembling the signature from step (a) with other business documents, such as a business reply envelope. Step (a) may be practiced by printing personalized indicia in a border area of the signature (particularly if the personalized indicia is to be bar code—which is normally visually unacceptable in the final product), in which case there is the further step (f) of cutting off the border area after step (d) is practiced. These steps may be continuously repeated to produce a plurality of different types of books, but all books having address information with common postal code, regardless of type, are produced in sequence, for securing a minimum postal rate.

According to another aspect of the present invention, a method of forming a book, having a cover, from signatures, including the cover, comprises the steps of automatically: (a) Printing personalized printing, including address information, directly on the cover. (b) Assembling the signatures, including cover, so that the address information is on, or will be on, the outside of the cover. And, (c) trimming the signatures to form a book.

According to yet another aspect of the present invention, a method of forming a book, having a cover adapted to receive address information, from a plurality of signatures is provided. The method comprises the steps of automatically: (a) Printing at least a first signature having specific demographic appeal in a plurality of different types of forms, each type of form having different demographic appeal than the others. (b) Assembling the first signature with at least a second signature, to form a book. (c) Correlating said plurality of different types of forms to address information in a data base with common postal codes. (d) Assembling in sequence the books with common postal code address information to be applied thereto regardless of type of first signature forms, so as to obtain the greatest chance for the lowest possible postal rate. And, (e) printing address information on the cover of each book so that each addressee has a book with a first signature of desired demographic appeal. Steps (a)–(e) are preferably practiced by printing personalized indicia on the signatures, detecting the personalized indicia, and printing address information on the cover corresponding to the personalized indicia detected.

The invention also contemplates apparatus for forming books having covers adapted to receive address information. The apparatus comprises: means for printing at least one personalized signature with variable personalized printing (preferably a plurality of ion deposition printers); means for assembling a personalized signature with at least one other signature; means for detecting the personalized printing on the personalized signature (preferably optical scanners); and means —in response to the detecting means—for printing address information on the cover (preferably an ink jet printer).

The invention further contemplates a method of forming a book, having a cover, from first and additional signatures, including the cover, comprising the steps of automatically: (a) Printing personalized printing, including address information, so that it is provided on a portion of the first signature. (b) Forming a die cut window in a portion of the cover. (c) Assembling the signatures, including cover, so that the address information on the first signature is aligned with, and viewable through, the die cut window in the cover. And (d) trimming the signatures to form a book. Step (a) may be practiced by printing the address information on a label, and the method then may comprise the further step, prior to step (d) (e.g. between steps (b) and (c)), of automatically placing the label on the portion of the first signature visible through the cover die cut window. Alternatively, step (a) may be practiced by ion deposition or ink jet printing directly on the signature.

It is the primary objects of the present invention to provide a high degree of personalization to traditionally bound publications, and to obtain optimal postage rates on mailing such publications. These and other objects of the invention will become clear from an inspection of the detailed description of the invention, and from the appended claims.

BRIEF DESCRIPTION OF THE DRAWINGS

FIG. 4 is a detail schematic of another form of an exemplary book according to the invention with a die cut window in the cover for the address area on a signature showing through;

DETAILED DESCRIPTION OF THE DRAWINGS

Figure 1:
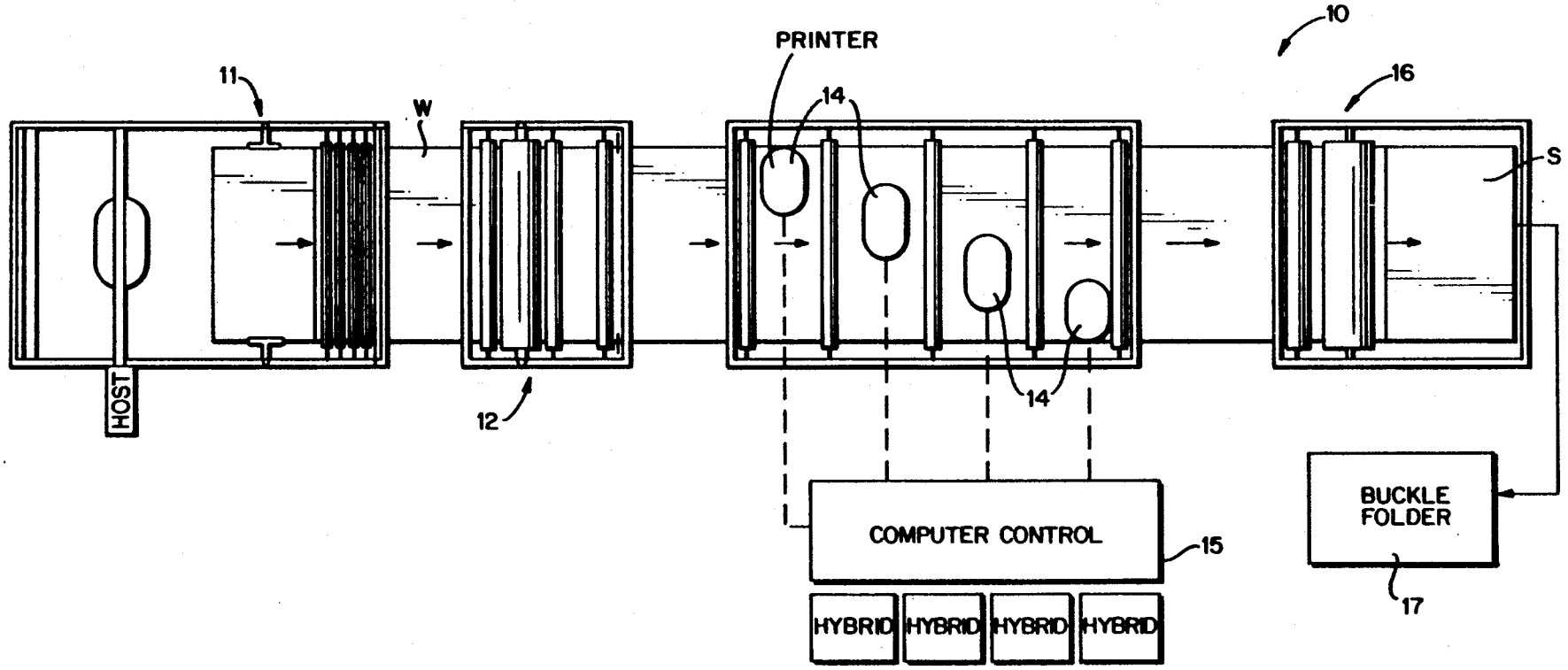
FIG. 1 is a schematic of exemplary equipment for practicing the method according to the invention to produce large cut sheets.

Exemplary apparatus for printing and folding signatures for assembly with other signatures to produce books, having covers adapted to receive address information, is illustrated generally by reference numeral 10 in FIG. 1. Webs W of paper, or like sheet material used to form the book, such as 35.5 inch width webs, are fed from conventional splicer 11 through conventional tension control/edge guide 12 to the printing apparatus 13. The splicer 11 may comprise a Martin automatic splicer. If a 35.5 inch web is used, a plurality of printers 14 are utilized at the printing station 13, e.g. four staggered, but overlapped, printers 14.

Non-variable information that is provided on the web W preferably is printed thereon before it is provided to the apparatus 10, although under some circumstances it could be printed, along with the variable information, by the printing station 13.

Preferably, the printers 14 are ion deposition printers, such as the MIDAX printers of Moore Business Forms, Inc. or like Delphax ion deposition printers. Such printers apply toner to the web W during printing to produce very high quality, optically scannable (detectable) indicia. The printers 14 are controlled by a conventional computer control 15, such as an A. M. Harris Electropress, a Kodak Diconix Multiplex, or a proprietary system of Moore Business Forms, Inc. known as the XL Data System. From the printer 13, the web W passes to a sheeting apparatus 16 (such as an Egan sheeter), and the individual sheets S produced thereby are fed to a conventional buckle folder 17. The individual sheets S are personalized signatures (e.g. $\frac{1}{4}$ signatures, that is having four pages, $\frac{1}{2}$ signatures, that is having eight pages, or full signatures, that is having 16 pages).

As an alternative to the system illustrated in FIG. 1, instead of staggering the printers 14 as illustrated in FIG. 1, loose loop technology may be utilized passing the web W sequentially to different MIDAX 334, or like, printers.

The buckle folder 17 typically folds the signature S into individual "pages" having a dimension of $8\frac{7}{8}$ inches $\times 11\frac{3}{8}$ inches, which will ultimately be trimmed—as described hereafter —to $8\frac{1}{2} \times 11$ inch sheets. The personalized signatures may be fed from the buckle folder 17 directly to the binding apparatus—shown generally by reference numeral 19—in FIG. 2, or to a storage area, and from the storage area to the apparatus 19.

The personalized indicia that is printed onto the personalized signatures S by the printing apparatus 13 must be capable of being scanned. For example it must be optically scannable, such as OCR readable printing—as illustrated schematically at 20 and 21 in FIG. 3—or bar code—such as illustrated at 22 in FIG. 3. Alternatively it may be MICR or magnetic stripe data that may be detected by a magnetic reader.

Normally, bar code data is visually unacceptable in the final product, therefore if the bar coding 22 is printed it preferably is printed in a border area 23 of the signature S that will ultimately be trimmed before the final book is produced.

The personalized indicia that is printed may be name information (illustrated by 20 and 22 in FIG. 3), an ID number, such as a person's social security number, subscriber number, or the like (as illustrated at 21 in FIG. 3), and/or a photograph 24 of the subscriber/addressee. Entire address information (not shown in FIG. 3) may also be printed on the personalized signature page 25 illustrated in FIG. 3, or the complete address information may be stored in a data base and retrieved from the data base after detecting of any one of the indicia 20–22, 24. A perforation line 26 may be formed in page 25 to provide a return form 27.

The binding apparatus 19 includes a conventional gathering line 28 which receives signatures from feeders 29–31, or the like, and gathers the signatures from feeders 29–31 with a cover fed by the cover feeder 32 (if the cover paper, or other web material, is different in construction than the paper of the signatures), and they are fed to a conventional stitcher 33. Any number of feeders 29–31 may be utilized. Typically only one of the signatures—that is from one of the feeders 29–31 (e.g. feeder 29)—will be personalized, and if the personalized signature will be always fed by the same feeder then only one detector is necessary. However in order to provide maximum flexibility, and redundancy, it is preferred that a detector 35 be provided downstream (in the direction 36 of movement along the gathering line of each of the feeders 29–31.

The construction of the detectors 35 will be dependent upon the particular variable, detectable, personalized printing that is provided on the personalized signature S that is to be detected. For example if OCR printing or bar code is printed on the signature S then the detectors 35 will be optical scanners, whereas if MICR or magnetic stripe printing is utilized, the detectors 35 will be magnetic detectors.

Downstream of the stitcher 33 is an intelligent print station 38. This may include an ion deposition printer, but since merely address information is being printed on the cover utilizing the print station 38, preferably it comprises an ink jet printer. The intelligent print station 38 is controlled by a computer control 39, which receives information from the detectors 35, processes it, and then controls the print station 38 to print the appropriate address information on the cover of the book being produced. After printing of the address information on the cover, the book goes to a conventional trimmer 40—such as a conventional 3-knife trimmer—in which the border edges (e.g. a bottom border of 3/16 inch as seen at 23 in FIG. 3, and a like 3/16 inch border at the top—not shown in FIG. 3) is trimmed, and then the book is fed to a conventional stacker/wrapper 41.

Figure 3:
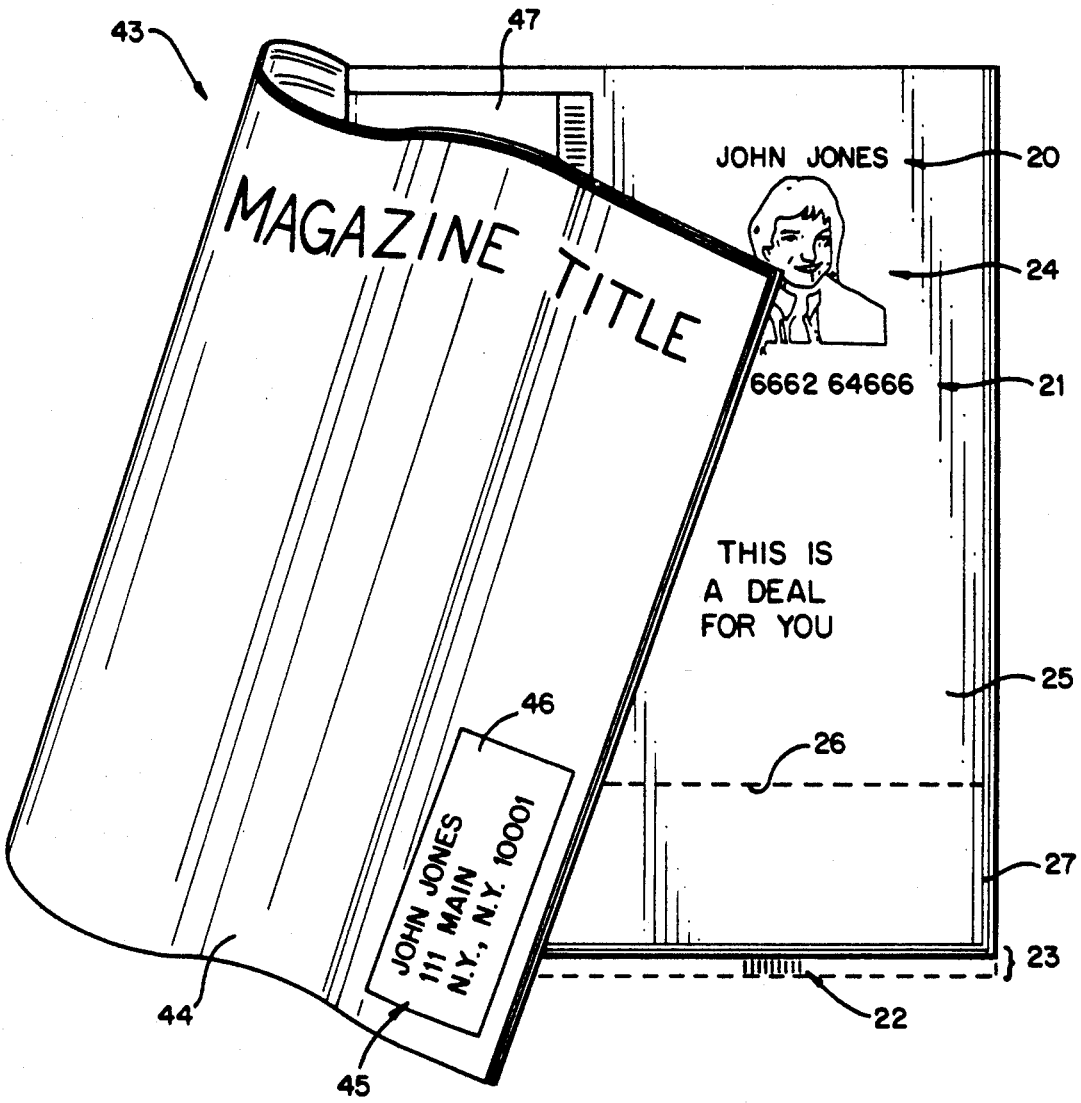
FIG. 3 is a schematic perspective of an exemplary book produced according to the invention having a high degree of personalization.

The final book produced is illustrated generally by reference 43 in FIG. 3, and includes the cover 44, pages from non-personalized signatures, and pages from the personalized signature S, such as the page 25. The personalized information, such as a name 20, ID number 21, bar code 22, or even address information (if provided) on the page 25 is scanned by scanner 35, that information is transmitted to the computer control 39 (which is a matching logic system, such as a Moore proprietary XL Data System, the Kodak Diconix Multiplex, or the A. M. Harris Electropress), and then the address information 45 corresponding to the personalized information is printed on the cover 44. The address information 45 is preferably printed directly on the cover 44, or it may be printed on a pressure sensitive adhesive label 46 which has been pre-applied to the cover 44, or it may be printed on a label 46 which is applied to the cover 44 immediately after printing.

In addition to assembling the personalized signature S with other signatures utilizing the apparatus 19, it may be assembled with other business documents too. For example, it may assembled with a business reply envelope 47 (see FIG. 3), which will have the advertiser's name printed at the addressee location thereon, and may have the subscriber's name (e.g. 20) on the return address portion thereof. The return form 27 may be detached at perforation 26 and inserted in envelope 47.

Figure 4:
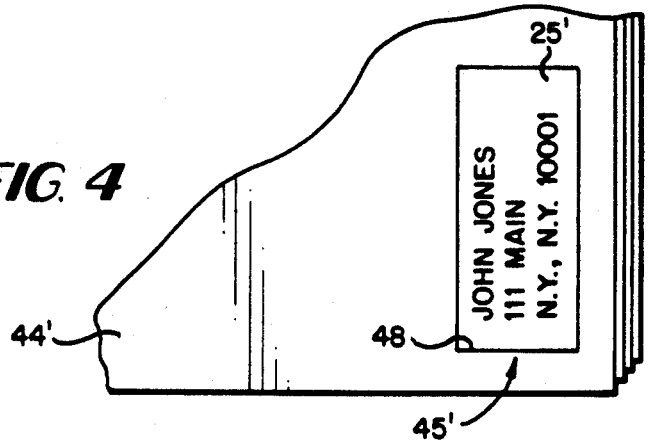

FIG. 4 is a detail view of a part of another exemplary form of a book according to the invention. In this embodiment structures comparable to those in the FIG. 3 embodiment are shown by the same reference numeral, only with a "'" thereafter.

In the FIG. 4 embodiment, complete address information 45' about the recipient is automatically printed directly on signature page 25'. The cover 44' has a die cut window 48 automatically formed therein, through which the address information 45' is visible. This allows the address information to be printed only once—on signature page 25'—yet provide for proper addressing of the book in situations where the signature page 25' is the second page of the book (or close to the second page if die cut windows are formed in pages intervening between signature page 25' and cover 44').

Figure 2:
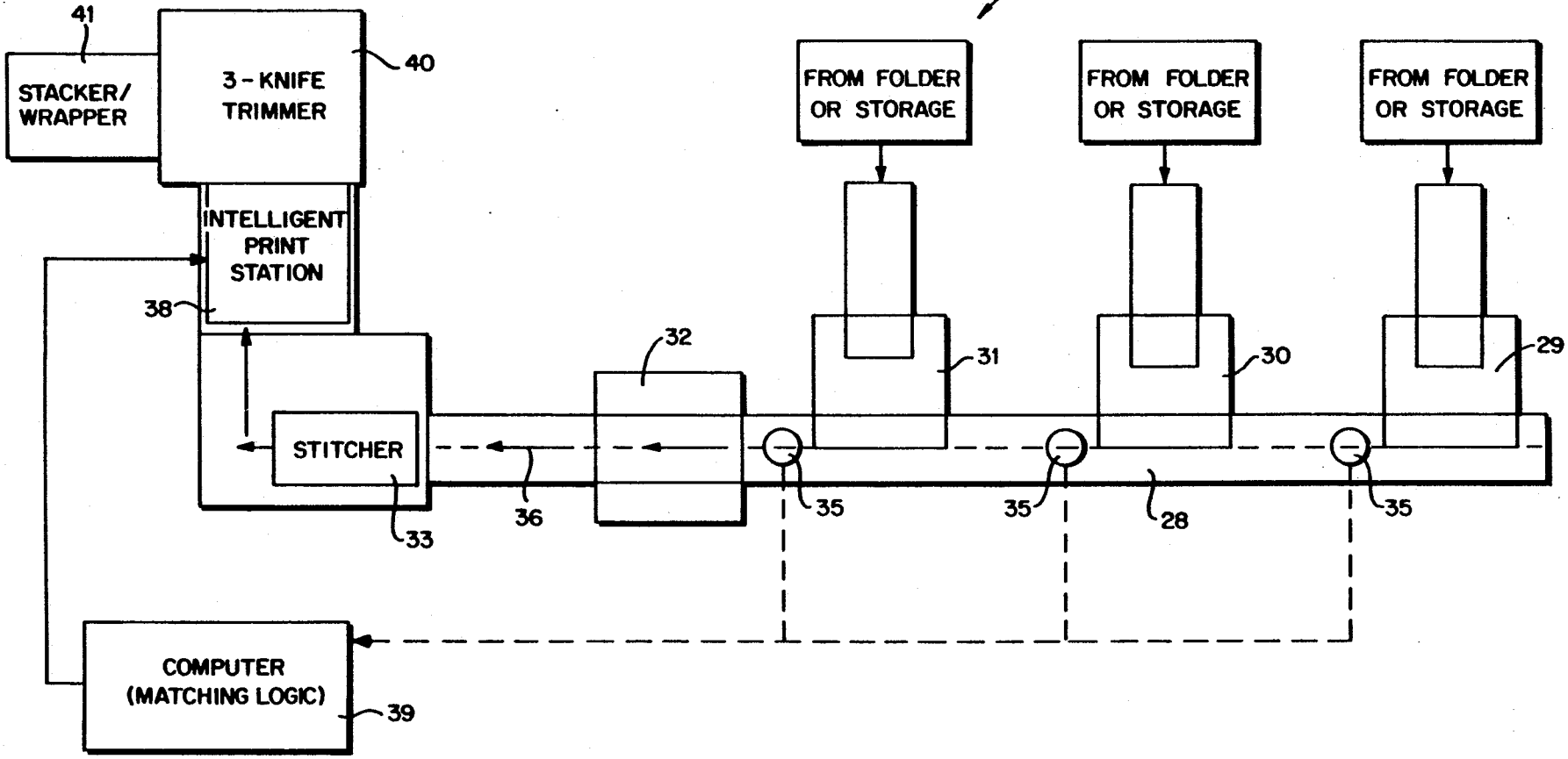
FIG. 2 is a schematic illustrating apparatus for practicing the method of the invention where stacks of imaged signatures are fed and merged with conventionally printed signatures, and bound.

Instead of the signature address information 45' being printed directly on page 25', it may be provided on a pre-imaged label, like the label 46, which label is automatically placed on the signature page 25' at some point in the process, such as after printing of the signature with variable information, but before assembly with the equipment of FIG. 2. A machine detectable mark may be provided on signature page 25' at the portion thereof on which the label is to be applied to facilitate automatic application of the label, and label application may be integrated with the equipment of FIG. 2.

Figure 5:
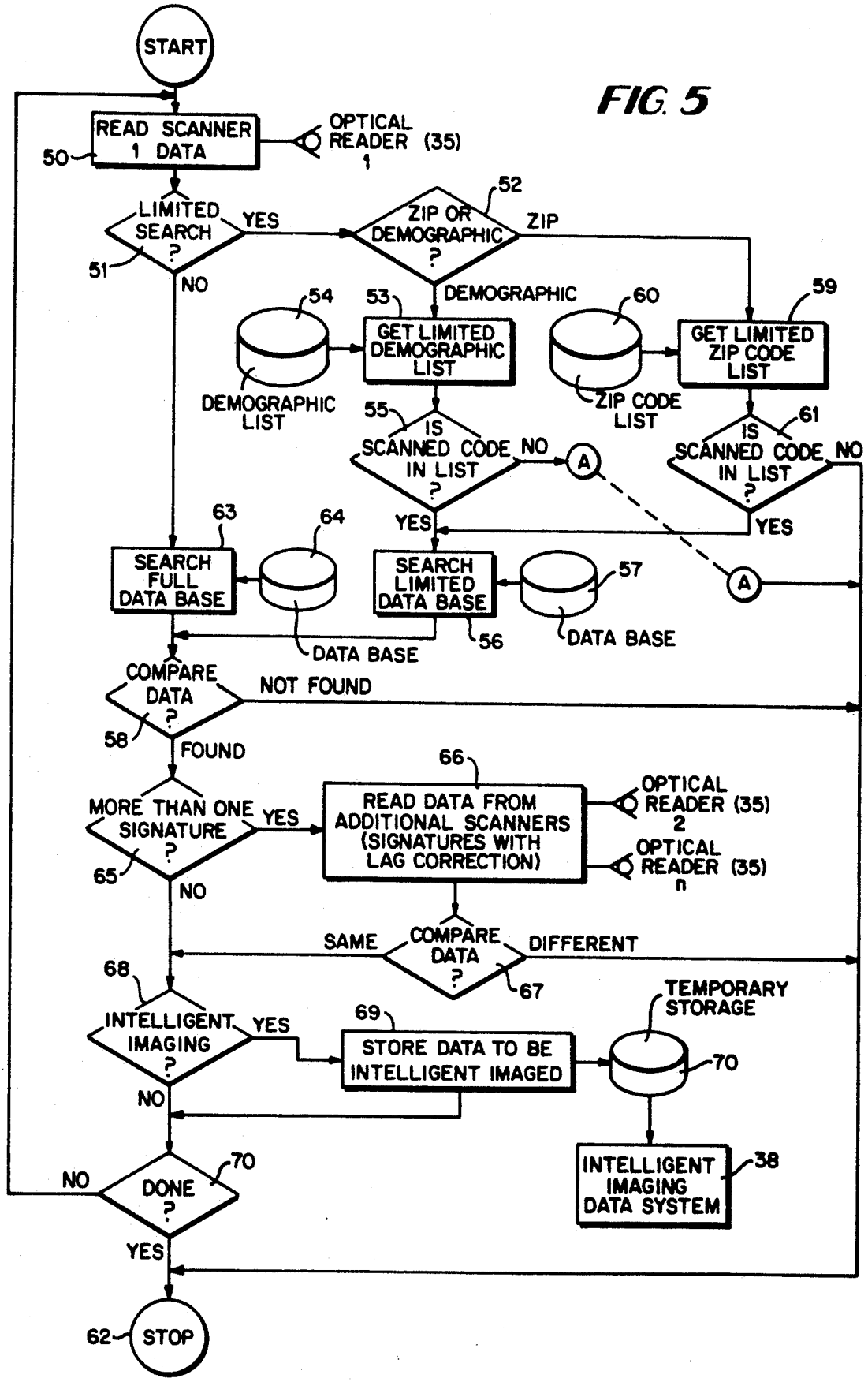
FIG. 5 is a logic flow chart illustrating the control sequence of an exemplary method according to the invention utilizing optical scanning with or without addressing with full or limited data base searching.

A logic flow chart showing one manner of operation of the apparatus of FIG. 19 is illustrated in FIG. 5. The FIG. 5 embodiment is illustrated assuming use of an optical reader 35, although it would be just as applicable if the reader 35 were a magnetic reader.

The optical variable information, e.g. 20–22, on the personalized signature S is read by an optical reader 35 and is fed to the computer 39, i.e. the "read scanner 1 data" block 50. A decision block 51 looks at the data and determines whether a limited search or full search is to be conducted in the data base. If a limited search is to be conducted, at decision block 52 it is determined whether or not the search will be by zipcode (postal code) or by demographic information. At block 53, limited demographic list information is provided from the demographic list 54, and then at decision block 55 it is determined if the scanned code is in the list. If it is, then the search limited data base block 56 is implemented, utilizing the information from the data base 57, and this information is provided to decision block 58. If it is not, then the postal code routine is initiated.

In the postal code routine, at block 59 limited zipcode list information is provided from the zipcode list 60, and then at decision block 61 it is determined if the scanned code is in the list. If it is, then the routine merges with the demographic routine just before the block 56, and if it is not, it merges with the main routine just before the stop routine 62.

Connected to the "no" decision of the decision block 51 is the "search full data base" block 63, connected to the full data base 64. This is connected to the decision block 58 at which the data is compared. If the data is found, then decision block 65 "More than one signature?" looks at the data. If there is a "yes" decision from block 65, then data is read from additional scanners 35 (e.g. the personalized signature is from feeder 29 so that there are other scanners 35 downstream to check the first scanner 35) at block 66 "Read data from additional scanners/signatures with lag correction". If the data compared at decision block 67 is the same, then there is a return to the main loop, while whereas if it is different it is rejected (to just before the stop routine 62).

With a "no" decision from block 65, or a "same" decision from block 67, the decision block 68 determines whether or not intelligent imaging is to occur. If "yes", then the data to be intelligently imaged is stored at block 69, using temporary storage 70, and ultimately intelligent print station 38 is provided with the data once the book associated with that personalized data reaches the print station 38, whereas with a "no" decision block 71 is implemented.

Figure 6:
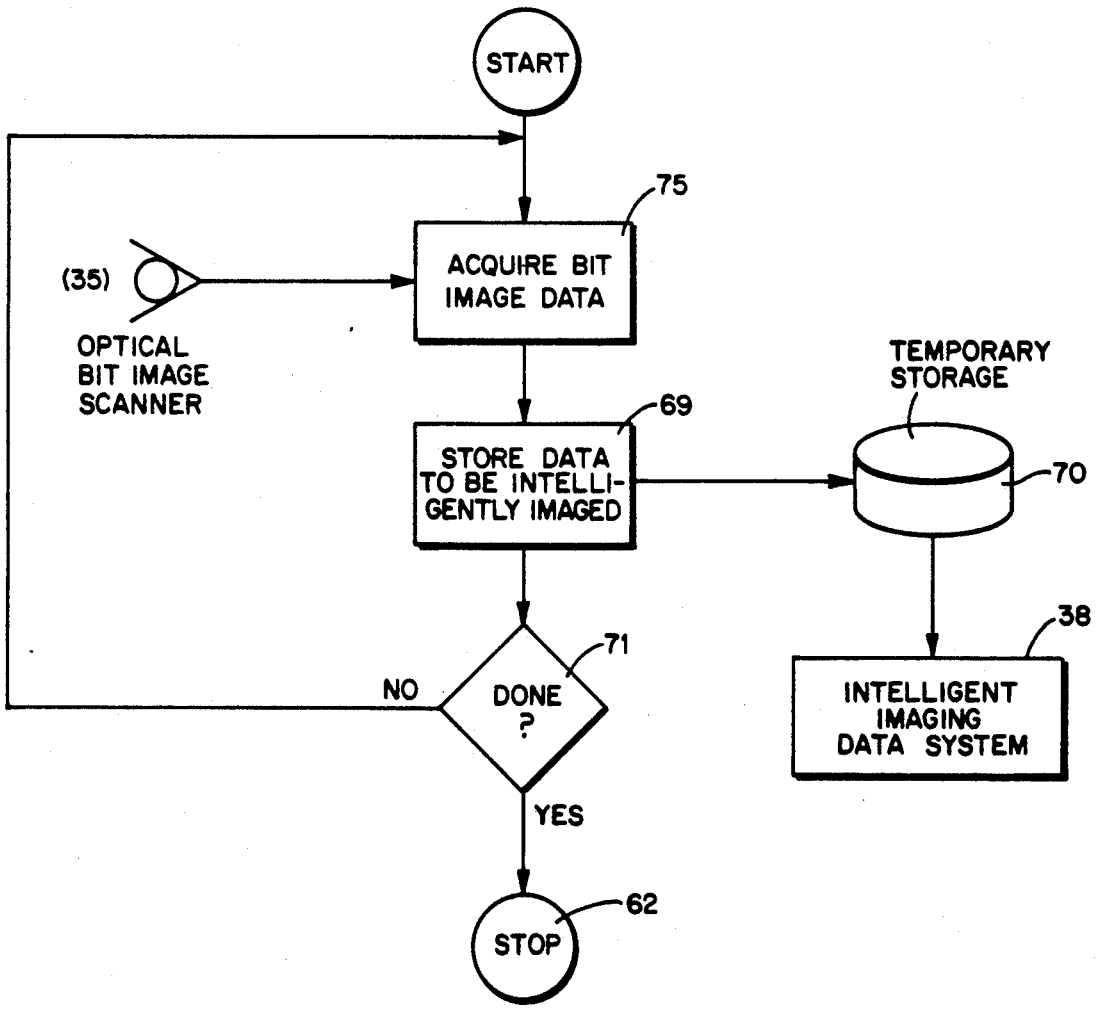
FIG. 6 is a logic flow chart for an imaged address sequence.

Instead of utilizing the flow chart of FIG. 5, if the complete address information is printed on the sheet 25, the logic flow chart illustrated in FIG. 6 is utilized. In this situation, the bit image data is acquired at block 75 from the optical bit image scanner (35), and then elements corresponding to elements 69 through 71 in FIG. 5 are implemented.

According to the invention, a method of forming a book 43, having a cover 44 adapted to receive address information 45 thereon, from a plurality of signatures (including personalized signature S) is provided. The method comprises the steps of automatically, and substantially sequentially: (a) Printing at least one personalized signature S, utilizing the apparatus 10, with variable, detectable, personalized printing (e.g. 20–22, and/or 24). (b) Assembling the personalized signature S with at least one other signature utilizing the apparatus 19. For example the personalized signature S is fed by feeder 29 to the gathering line 28, while other signatures are provided by feeders 30, 31, and a cover—if different from the other signatures—is provided the cover feeder 32. (c) Detecting the detectable personalized printing on the personalized signature S utilizing at least the first detector 35, and preferably the redundant detectors 35 downstream of the first detector. Where the variable, detectable, personalized printing is optical (e.g. OCR or bar code), optical scanning will be practiced with the scanners 35, whereas if it is MICR or magnetic stripe, the detectors 35 will be magnetic readers. And, after stitching with stitcher 35, (d) in response to step (c), address information will be printed on the cover 44 (that is corresponding to the personalized information 20–22 and/or 24). This is accomplished by the matching logic control 39 receiving information from the detectors 35 and then controlling the intelligent print station (e.g. ink jet printer) 38.

There may also be the step (e) of assembling the personalized signature with other business documents (such as the return envelope 48), and—particularly where non-visually acceptable, such as bar code 22, detectable personalized printing is printed in a border area 23—(f) cutting off the border area 23 utilizing the knife trimmer 40.

In the practice of the method described above, care is taken to also obtain a minimum postal rate. This is accomplished by printing in sequence, or sorting after printing, all books 43 having common postal codes, and this can be accomplished even with a number of different forms of the books 43. For example, in many demographic publishing operations, a plurality of different types of forms are produced, each form having different demographic appeal than the others. For example this may be accomplished according to the following steps: (a) Printing at least a first signature S having specific demographic appeal in a plurality of different types of forms, each type of form having different demographic appeal than the others. (b) Assembling (with 19) the first signature with at least a second signature, to form a book. (c) Correlating the plurality of different types of forms to address information in a data base with common postal codes. (d) Assembling in sequence the books with common postal code address information to be applied thereto regardless of type of first signature forms, so as to obtain the greatest chance for the lowest possible postal rate. And, (e) printing (with 38) address information on the cover of each book so that each addressee has a book with a first signature of desired demographic appeal. Of course according to the invention it is preferred that steps (a)–(e) are practiced by printing personalized indicia (e.g. 20–22) on the first signatures, detecting the personalized indicia (with 35), and printing address information (45) on the cover 44 corresponding to the personalized indicia detected.

According to the invention there is also provided a method of forming a book 43 and personalized information—including the address information 45—is printed directly on the cover 44 (e.g. not on a label 46 which is applied to the cover 44), typically after assembly of the signatures, including cover, so that the address information is, or will be, on the outside of the cover 44, and trimming the signatures to form a book 43, utilizing the apparatus in FIG. 2.

It will thus be seen that according to the present invention a method and apparatus are described which provide a high degree of personalization to traditionally bound publications, and provide for demographic publishing with the greatest chance of obtaining the lowest possible postal rates. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of forming a book, having a cover adapted to receive address information, from a plurality of signatures, comprising the steps of automatically:

(a) printing at least one personalized signature with variable, detectable, personalized printing;

(b) assembling the personalized signature with at least one other signature;

(c) detecting the detectable personalized printing on the personalized signature; and (d) in response to (c), printing address information on the cover.

2. A method as recited in claim 1 wherein step (a) is practiced by printing a bar code on the personalized signature, and step (c) is practiced by optically scanning the bar code.

3. A method as recited in claim 1 wherein step (a) is practiced by printing OCR characters on the personalized signature, and step (c) is practiced by optically scanning the OCR characters.

4. A method as recited in claim 1 wherein step (a) is practiced by printing complete mailing address information on the personalized signature, and step (c) is practiced by optically scanning the complete mailing address information; and wherein step (d) is practiced by temporarily storing the complete address information, and then printing essentially that same information on the cover.

5. A method as recited in claim 2 wherein step (d) is practiced by comparing the personalized printing detected in (c) with information in a data base, and withdrawing favorably compared information from the data base.

6. A method as recited in claim 3 wherein step (d) is practiced by comparing the personalized printing detected in (c) with information in a data base, and withdrawing favorably compared information from the data base.

7. A method as recited in claim 1 wherein step (a) is practiced by applying toner to the signature.

8. A method as recited in claim 7 wherein step (c) is practiced by optically reading the applied toner.

9. A method as recited in claim 1 wherein step (c) is practiced by optically reading the personalized printing.

10. A method as recited in claim 1 wherein step (c) is practiced by magnetically reading the personalized printing.

11. A method as recited in claim 1 wherein step (a) is practiced to print the name, photograph, or I.D. number of a person corresponding to the address information printed in step (d).

12. A method as recited in claim 1 comprising the further step (e) of assembling the signature from step (a) with other business documents.

13. A method as recited in claim 12 wherein step (e) is practiced by assembling the personalized signature with a business reply envelope.

14. A method as recited in claim 12 comprising the further step of forming a perforation in the signature from step (a) so as to provide a detachable, return form.

15. A method as recited in claim 1 wherein step (a) is practiced by printing personalized indicia in a border area of the signature; and comprising the further step (f) of cutting off the border area after step (d) is practiced.

16. A method as recited in claim 1 wherein step (a) is practiced by ion deposition printing, and step (d) is practiced by ink jet printing.

17. A method as recited in claim 1 wherein step (c) is practiced prior to step (b).

18. A method as recited in claim 1 wherein steps (a)-(d) are continuously repeated to produce a plurality of types of books, and wherein steps (a)-(d) are practiced so that all books have address information with common postal codes, regardless of types, are produced in sequence for securing a minimum postal rate.

19. A method as recited in claim 1 wherein step (c) is practiced simultaneously with step (b).

20. A method of forming a book, having a cover adapted to receive address information, from a plurality of signatures, comprising the steps of automatically:

(a) printing at least a first signature having specific demographic appeal in a plurality of different types of forms, each type of form having different demographic appeal than the others;

(b) assembling the first signature with at least a second signature, to form a book;

(c) correlating said plurality of different types of forms to address information in a data base with common postal codes;

(d) assembling in sequence the books with common postal code address information to be applied thereto regardless of type of first signature forms, so as to obtain the greatest chance for the lowest possible postal rate; and (e) printing address information on the cover of each book so that each addressee has a book with a first signature of desired demographic appeal;

steps (a)-(e) being practiced by printing personalized indicia on the first signatures, detecting the personalized indicia, and printing address information on the cover corresponding to the personalized indicia detected.

21. A method as recited in claim 20 wherein said step of printing personalized indicia is practiced by printing OCR characters, and wherein said step of detecting the personalized indicia is practiced by optically scanning the OCR characters.

22. A method as recited in claim 21 wherein said step of printing address information on the cover corresponding to the personalized indicia detected is practiced by comparing the personalized printing detected, by the optical scanning, with information in a data base, and withdrawing favorably compared information from the data base.

23. Apparatus for forming books having a cover adapted to receive address information, from a plurality of signatures, comprising:

(a) means for printing at least one personalized signature with variable personalized printing;

(b) means for assembling the personalized signature with at least one other signature;

(c) means for detecting the personalized printing on the personalized signature; and (d) means for, in response to (c), printing address information on the cover.

24. Apparatus as recited in claim 23 wherein said means (a) comprises a plurality of staggered ion deposition printers.

25. Apparatus as recited in claim 24 wherein said means (d) comprises an ink jet printer.

* * * * *